US005895690A

United States Patent [19]

Greisel

[11] Patent Number: 5,895,690

[45] Date of Patent: Apr. 20, 1999

[54] METHOD AND APPRATUS FOR APPLYING MORTAR TO THE UNDERSIDE OF A BUILDING BLOCK

[75] Inventor: Franz Xaver Greisel, Ortenburg, Germany

[73] Assignee: Greisel-Baustoff GmbH, Ortenburg, Germany

[21] Appl. No.: 08/733,064

[22] Filed: Oct. 16, 1996

[30] Foreign Application Priority Data

Aug. 14, 1996 [DE] Germany ..... 196 32 844

[51] Int. Cl.[6] ..... B05D 1/28; B05D 5/00; B05D 3/12

[52] U.S. Cl. ..... 427/428; 427/286; 427/207.1; 427/299; 427/355; 427/393.6; 427/403; 118/252; 118/258

[58] Field of Search ..... 427/428, 424, 427/207.1, 208.6, 286, 393.6, 403, 299, 355; 118/244, 252, 258; 52/749.14, 799.13, 747.12

[56] References Cited

U.S. PATENT DOCUMENTS

| | | | |
|---|---|---|---|
| 1,147,161 | 7/1915 | Goldsmith | 118/244 |
| 2,564,492 | 8/1951 | Moffat . | |
| 3,052,565 | 9/1962 | Chinn et al. | 427/256 |
| 3,684,561 | 8/1972 | Labombarde | 427/428 |
| 4,010,203 | 3/1977 | Aylon . | |
| 4,182,786 | 1/1980 | Hertel | 427/428 |
| 4,391,664 | 7/1983 | Kramer | 156/71 |
| 4,503,096 | 3/1985 | Specht | 427/359 |
| 4,770,909 | 9/1988 | McIntyre | 427/428 |

FOREIGN PATENT DOCUMENTS

| | | |
|---|---|---|
| 2358529 | 2/1978 | France . |
| 76029 | 12/1893 | Germany . |
| 3018970 | 11/1981 | Germany . |
| 4226795 | 2/1994 | Germany . |
| 4334096 | 4/1995 | Germany . |

*Primary Examiner*—Shrive Beck
*Assistant Examiner*—Michael Barr
*Attorney, Agent, or Firm*—Sughrue, Mion, Zinn, Macpeak & Seas, PLLC

[57] ABSTRACT

A method and apparatus for applying mortar to the underside of a building block to be laid so that the mortar to be applied is automatically conveyed upwardly from a mortar supply container into a mortaring region where it is applied to the underside of the building block. The mortar can be sprayed onto the building block or applied thereto by a rotating coating roller, thereby automating the application of mortar and also reducing the consumption thereof.

10 Claims, 3 Drawing Sheets

METHOD AND APPRATUS FOR APPLYING MORTAR TO THE UNDERSIDE OF A BUILDING BLOCK

BACKGROUND OF THE INVENTION

The invention concerns a method of applying mortar to the underside of a building block to be laid, and an apparatus for carrying out that method.

The term building block is used broadly to denote blocks, bricks and the like of varying sizes and configurations, which are to be laid in various structures for building purposes.

In laying brickwork it is still the usual practice for the mortar, in particular for the bed joints, to be applied by hand to the top side of the brickwork which has already been erected, and then for the next layer of building blocks or bricks to be put on to the mortar bed prepared in that way. That is also the case when for example so-called flat blocks produced from porous concrete are laid by means of thin-bed mortar, which is frequently also referred to as the 'bonding agent'.

The procedure involving applying and distributing the mortar or thin-bed mortar, which hitherto usually precedes laying the next layer of building blocks, requires a high degree of experience and skill in order to overcome a whole series of difficulties.

Thus for example a relatively accurately controlled amount of mortar has to be put on to the top side of the brickwork and distributed with a very high degree of uniformity over a portion whose length greatly depends on the conditions prevailing at that time. If for example mortar with a relatively low water content is distributed over an excessively long length of brickwork which at that time is exposed to strong sunlight, then during the period of time, that is required for the subsequent operation of laying the next layer of building blocks, the -mortar in the portion in which the last blocks are to be laid may already have dried to such an extent that there is no longer any guarantee of producing a proper bonding effect and the old material has to be scraped out and replaced by fresh mortar. A corresponding consideration also applies when using mortar at temperatures of below 0° C., at which an excessively long period of time between the step of applying the mortar and laying a building block thereon can result in the mortar freezing.

The layer of mortar which is applied first is also urged apart in the horizontal direction by virtue of the weight of the building block laid thereon and the pressing force which is to be exerted in order to make the bed joint of uniform thickness. If an excessive amount of mortar was applied, the result is that the mortar material comes out of the bed joints and runs down on the brickwork surfaces, and that makes it necessary to carry out a subsequent cleaning operation. If too little mortar was applied, there is no guarantee of a proper bonding action.

If the building blocks to be laid do not have a closed top side or if their abutting surfaces have irregular gaps or engagement recesses which are intended to permit the building block to be gripped by means of gripping cradles, a relatively large amount of material drops into those vertical gaps when mortar is applied manually so that the consumption of mortar is unnecessarily high unless the procedure is conducted with a high degree of care. The latter however involves an increased amount of time, even for a skilled bricklayer.

In order to obviate those difficulties, in particular in regard to the consumption of mortar, a method of applying mortar to building blocks has therefore already been proposed (German laid-open application (DE-OS) No 42 26 795) in which the building block is fitted on its surface which in the brickwork forms the underside, on to a so-called metering grid and jointly with same pressed against the surface of the supply of mortar which is made ready in a tank or vat. In that case, mortar material passes through the open meshes of the metering grid and remains adhering to the underside of the building block. The metering grid is intended to ensure in that case that the layer of mortar adhering to the building block is of approximately uniform thickness which, when the building block is put on to the brickwork which has already been erected, is rendered further uniform by virtue of the fact that the mortar material is distributed into the surface regions of the underside of the building block, which were initially not covered with mortar because of the shielding effect of the bars of the metering grid.

As with that known method the amount of mortar adhering to the underside of the building block is very heavily dependent both on the surface nature of the building block and also on the consistency of the mortar, and as those parameters can vary greatly from one case to another, the thickness of the layer of mortar which is actually achieved is still substantially dependent on the skill of the operator using the known apparatus, and in particular the force with which the operator presses the metering grid with building block disposed thereon, against the surface of the supply of mortar. That pressing force cannot be adapted to a given situation by a one-off adjustment, but has to be kept within relatively narrow limits afresh in each individual pressing operation. The step of individually putting the building blocks on to the metering grid and the operation of pressing that unit against the surface of the supply of mortar, under a defined force, is also a procedure which consumes a relatively large amount of time.

SUMMARY OF THE INVENTION

Accordingly the object of the present invention is to provide a method, and to apparatuses which are suitable for carrying the method into effect, so that building blocks and in particular flat blocks made from porous concrete can be quickly provided with mortar, without involving high levels of requirement in terms of skill, in a manner which is economical in regard to material and which results in satisfactory brickwork structures which fully comply with the civil-engineering regulations involved.

The invention provides the features recited in claims 1 and claims 9 and 10 respectively, to attain that object.

Features according to the invention provide that a layer of mortar is applied to the underside of the building blocks automatically and thus under conditions which always remain the same, in which respect the parameters which are required for that purpose have to be matched to the consistency of the mortar and environmental influences such as temperature and air humidity and the like only at the beginning of a relatively long operating procedure which involves applying mortar to many building blocks, but those parameters can remain constant over a long period of time after the above-indicated matching procedure has been effected, without the operator having to perform fresh matching operations afresh for each mortar-application operation or having to bring his personal experience values to bear.

The mechanical devices, by means of which the mortar is conveyed out of the supply of mortar upwardly and against the underside of the building block in such a way that it adheres thereto can be easily so designed that they operate uniformly and reliably and one block after the other is provided with the required layer of mortar.

Tests with apparatuses operating in accordance with the method of the invention, have shown that, when applying thin-bed mortar to flat blocks, it is possible to achieve a saving on mortar of up to 40% in comparison with the conventional manual mortar-application methods, and a comparable saving in terms of time.

A particular advantage of the method according to the invention is that the building block no longer has to be turned or rotated after the mortar has been applied. It can retain its spatial orientation from the mortaring operation until it is laid on the brickwork, at least in such a way that its underside which is provided with mortar thereon constantly remains facing downwardly.

These and further advantages of the method according to the invention and of the apparatuses for carrying the method into effect are set forth in the appendant claims.

BRIEF DESCRIPTION OF THE DRAWINGS

The invention is described hereinafter by means of an embodiment with reference to the drawing in which.

Figure 1:
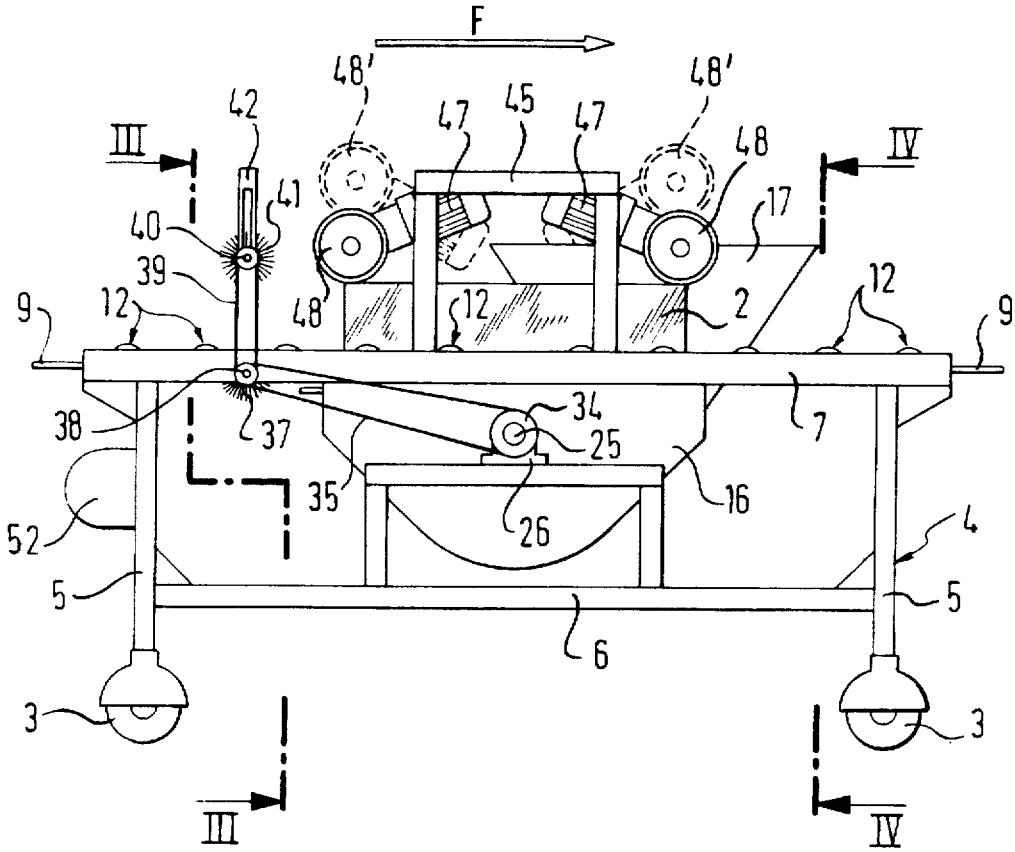
FIG. 1 is a side view of an apparatus for carrying out the method according to the invention.

The apparatus for applying mortar to the underside 1 of a building block 2, as shown in FIGS. 1 through 4, is mounted on a table-like frame support structure 4 which is movable on four wheels 3 and which is essentially formed by shaped metal members or tubes which are welded together and which include four vertical support posts 5, four lower connecting frame members 6, two upper longitudinal frame members 7 and two upper transverse frame members 8, to each of which are secured outwardly projecting handles 9 which make it easier to push or pull and carry the movable frame support structure 4. Of the four wheels 3 two can be in the form of castor wheels (not shown).

Figure 4:
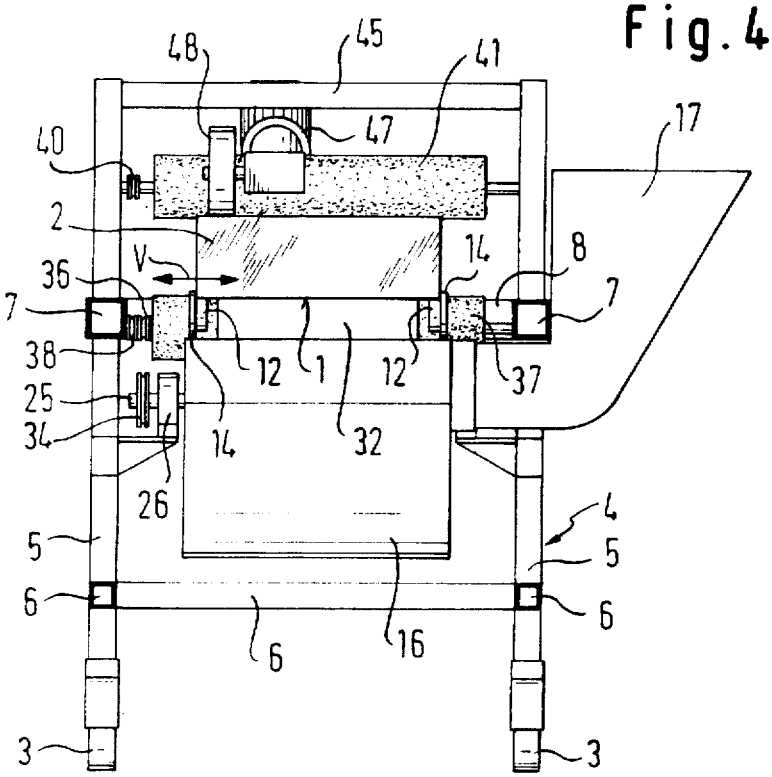
FIG. 4 is a view in section through the apparatus of FIG. 1 along line IV—IV.

Mounted at each of the mutually facing inward sides of the longitudinal frame members 7 is a respective row of free-running support and guide rollers 12 of which the row at the left in FIG. 4 is displaceable in the direction of the double-headed arrow V in order to be able to adapt the spacing between the radially projecting flanges 14 of the mutually oppositely disposed support and guide rollers 12, to the width of the respective building blocks 2 to be mortared.

Suspended between the two longitudinal frame members 7 is an upwardly open mortar vat or tank 16 which can be removed for cleaning purposes and into which the thin-bed mortar in the finished mixed condition can be introduced by way of a laterally disposed filling connection 17 which opens by way of the opening 18 (see FIG. 2) into the vat 16 so that a supply of mortar 20 is accommodated in the vat during operation of the apparatus.

A coating roller 22 dips into the supply of mortar 20. The coating roller 22 has a peripheral casing portion 23 comprising an elastic material, for example rubber, which can be satisfactorily wetted by the mortar, and which can be provided with knobs or similar irregularities (not shown) to enhance the adhesion of the mortar. The coating roller 22 thus rotates in the same direction as the forward feed movement of the building block 2 in the longitudinal direction of the latter. The feed movement is at a speed of between 15 m/minute and 20 m/minute.

Figure 2:
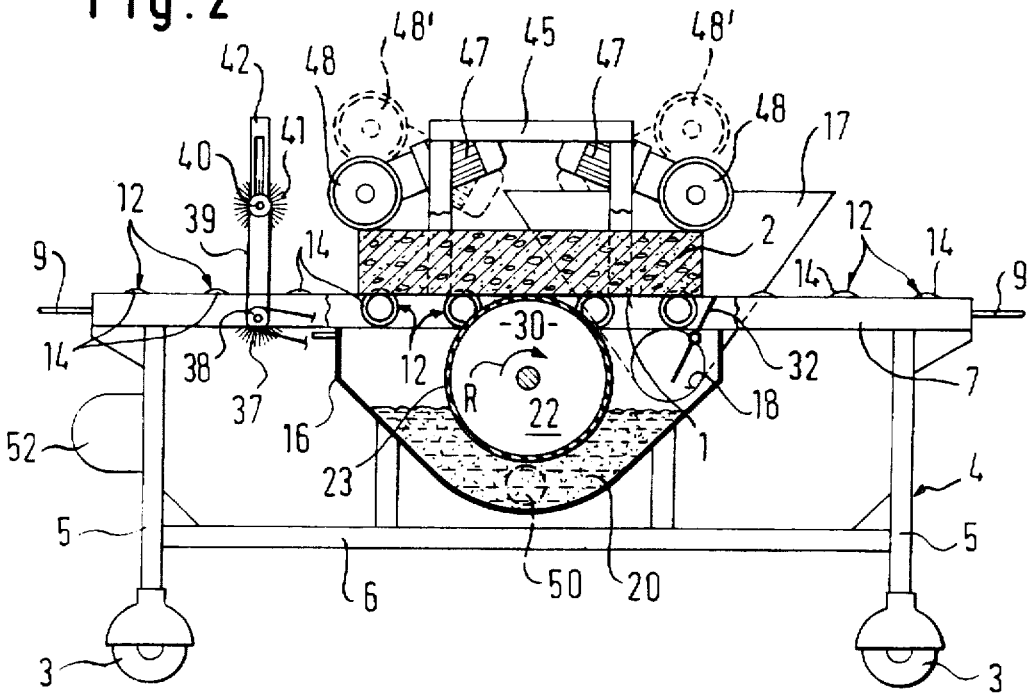
FIG. 2 is a side view corresponding to FIG. 1, but omitting the front wall of the mortar vat, which faces towards the viewer, and all parts which are between same and the viewer, in particular also a part of the front longitudinal frame member.
Figure 3:
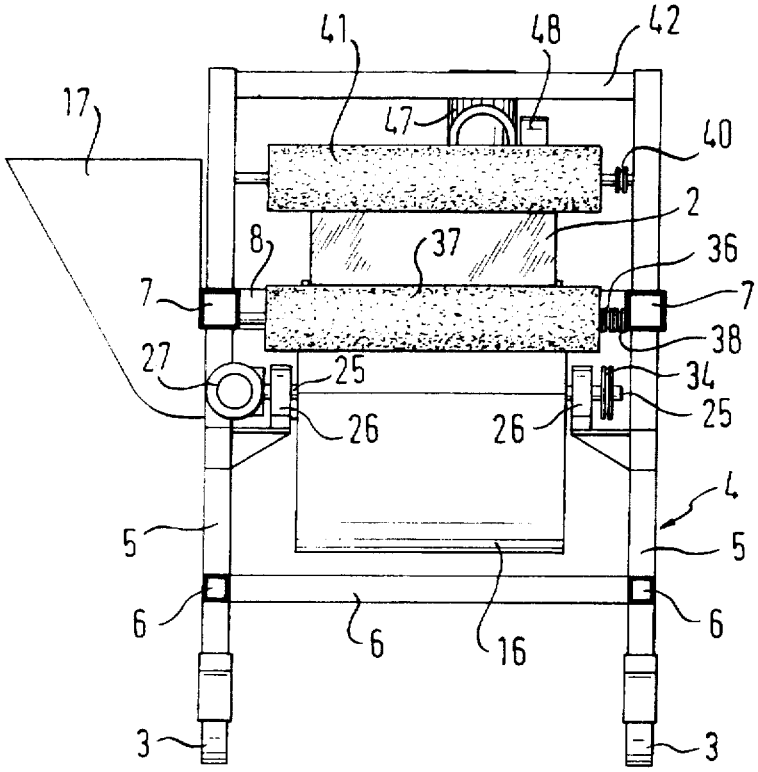
FIG. 3 is a view in section through the apparatus of FIG. 1 along line III—III.

The coating roller 22 is mounted in two bearing blocks 26, 26 mounted in the frame support structure 4, by means of journals 25, 25 (see FIG. 3) which extend outwardly through slots (not shown) which are cut from above into the flat walls of the vat 16, and the coating roller 22 is driven by an electric motor 27 with an angle transmission for rotation in the direction indicated by the arrow R (see FIG. 2).

By virtue of that rotary movement the coating roller 22 conveys a layer of mortar out of the mortar supply 20 upwardly into a mortaring region 30 in which that layer of mortar adhering to the coating roller 22 is pressed against the underside 1 of a building block 2 which is moved over the top thereof in the direction indicated by the arrow F, so that the layer of mortar comes away from the peripheral casing portion 23 and remains adhering to the building block 2. The bearing blocks 26, 26 are adjustable in a vertical direction (not shown) in order to be able to adjust the thickness of the layer of mortar adhering to the underside 1 of the building block, in dependence on the nature of the surface of the building block and the mortar consistency.

A corresponding consideration also applies in regard to a doctor 32 which, in the direction of movement F of the building block 2, is disposed downstream of the coating roller 22 in the interior of the vat 16 and which serves for post-treatment of the layer of mortar adhering to the underside 1 of the building block 2. The doctor 32 can be for example in the form of a toothed finishing member. The positioning of the doctor 32 in the mortar vat 16 provides that excessive mortar which is scraped off the underside 1 of the building block drops back into the mortar supply 20 and is available for further operation therewith, without contaminating the working area.

As can be seen more particularly from FIG. 4 the doctor 32 and in the same manner also the coating roller 22 which in that view is disposed therebehind are of smaller width than the building blocks 2 to which mortar is to be applied so that an edge strip portion remains mortar-free at the underside 1 of the building blocks 2, along both longitudinal edges thereof. That affords a series of advantages: on the one hand, as they pass through the apparatus according to the invention and if appropriate also upon further transportation thereof, the building blocks 2 rest with those mortar-free edge strip portions on the respective support and guide rollers 12 or similar items of equipment, without them being contaminated by mortar. On the other hand when the building blocks are put on to brickwork which has already been erected, the layer of mortar adhering to the underside 1 of the building blocks 2 can escape into those edge strip portions without the risk of being squeezed out of the joint in the brickwork and excess mortar running down the surfaces of the brickwork.

If building blocks of greatly different widths are to be handled in the apparatus according to the invention, it is desirable to use coating rollers and doctors of different dimensions which suit the respective building block dimension. As already mentioned above the spacing of the rows of support and guide rollers 12 is in any case adjustable for that purpose.

The journal 25 which is disposed opposite the drive motor 27 (see FIG. 3) carries a belt pulley 34 which is non-rotatably mounted thereon and which, by way of a belt 35 and a further belt pulley 36, drives a first brush roller 37 which, in the direction of movement F of the building block 2, is mounted upstream of the mortar vat 16 between the two longitudinal frame members 7 in such a way that it has a brushing action on the underside 1 of a building block 2 which is guided over same and thus removes loose dirt and dust from the underside 1 of the building block 2. The arrangement of the brush roller 37 upstream of the mortar vat 16 provides that material which is brushed off the building block 2 does not drop into the mortar supply 20.

A further belt pulley 38 which is also fixedly mounted on the shaft of the brush roller 37 jointly with the belt pulley 36 drives a second brush roller 41 by way of a further belt 39 and a belt pulley 40. The second brush roller 41 is mounted adjustably in respect of height on a support frame 42 mounted on the top of the frame support structure 4, in such a way that the second brush roller 41 cleans the top side of building blocks 1 which are passed through below it in the direction of the arrow F. The heightwise adjustability of the second brush roller 41 serves for adaptation to different building block dimensions.

Mounted over the mortaring region 30 on the top of the frame support structure 4 is a further support frame 45 mounting two friction wheels 48, 48 each driven by a respective electric motor 47, 47, tiltably about axes extending perpendicularly to the direction F of conveying movement of the building block 2, as is shown in FIGS. 1 and 2 on the one hand by the use of solid lines and on the other hand by the use of broken lines. Such tiltability of the friction wheels 48 also serves for adaptation to different block heights. In the operative position shown in solid lines in FIGS. 1 and 2, the friction wheels 48 press with their rubber casing or sheathing against the top of the building block 2 and move it by suitable rotational movement in the direction of the arrow F. In that respect the friction wheels 48 are so positioned that a building block 2 which is put on to the support and guide rollers 12 from the left in FIGS. 1 and 2 and which has been advanced sufficiently far towards the left-hand friction wheel 48 is engaged by that friction wheel and is then automatically pulled through between the brush rollers 37 and 41 and moved over the mortaring region 30. Then, in the course of that movement, the friction wheel 48 at the right in FIGS. 1 and 2 comes into engagement with the top of the building block and provides for further transportation of the building block even if the friction wheel 48 which is at the left in FIGS. 1 and 2 is no longer bearing against the top of the building block. In that way a building block which is fed to the apparatus shown in FIGS. 1 and 2 from the left-hand end thereof and which is initially advanced by hand is automatically conveyed on the free-running support and guide rollers 12 until it reaches the end of the assembly which is at the right in FIGS. 1 and 2. There, it can either be removed by hand or it can be advanced again by a downstream-disposed conveyor apparatus, as will be described in greater detail hereinafter with reference to FIGS. 5 and 6. Instead of or in addition to the friction wheels 48, 48 which come into engagement from above with the top of the building block 2, the apparatus may have friction wheels which engage the side surfaces of the building block, or the building block may be moved through the mortaring region 30 and past the downstream-disposed doctor 32 by means of a slider carriage which is reciprocable in the direction of the arrow F.

It is preferred however to use friction wheels 48 which press against the top of the building block 2 from above because they prevent the building block 2 from evading the force with which the coating roller 22 presses the mortar entrained thereby against the underside 1 of the respective building block.

Referring to FIG. 2, indicated in the mortar trough 16 beneath the coating roller 22 is a stirrer or agitator roller 50 which is arranged with its axis parallel to that of the coating roller 22 and whose rotary movement is coupled to the rotary movement of the coating roller 22 by means (not shown). The stirring roller 50 serves to prevent sedimentation of the supply of mortar 20 in the vat 16.

The above-described electric motors 27 and 47 are supplied with electric power by way of a common connecting cable (not shown). That connecting cable can be wound on to a symbolically illustrated drum 52 if the whole assembly is to be moved from one position of use to another.

Figure 6:
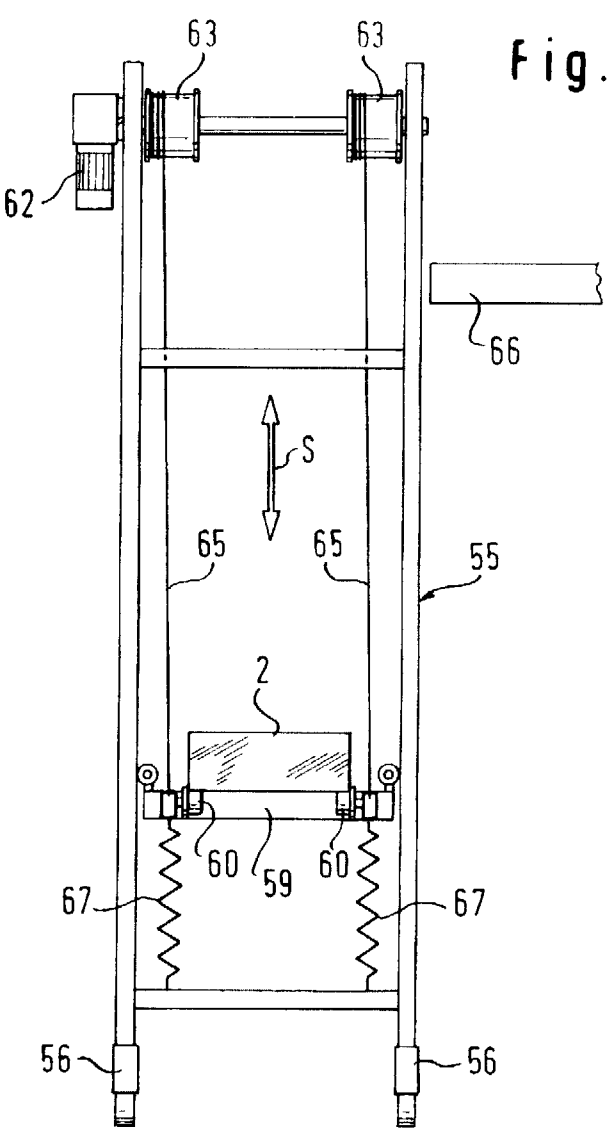
FIG. 6 is a view of the structure shown in FIG. 5 in the direction of the arrow VI—VI.
Figure 5:
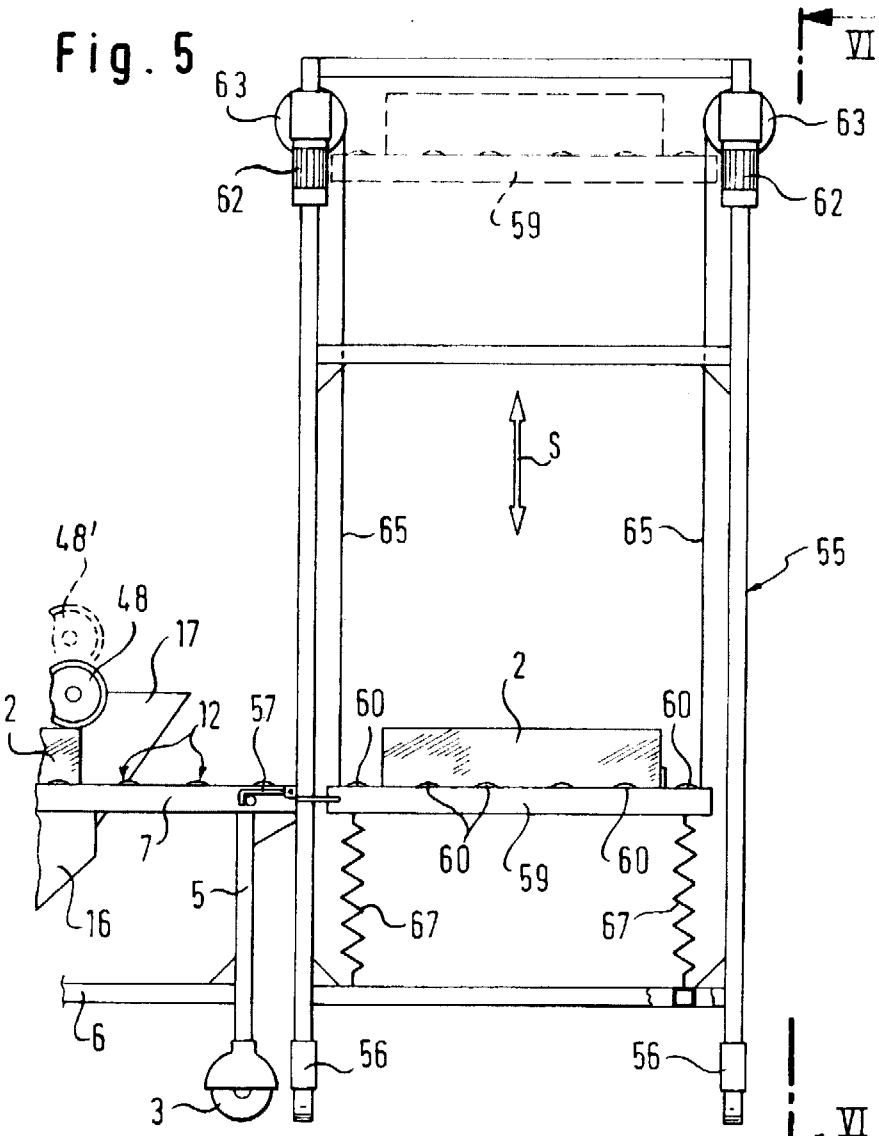
FIG. 5 is a side view of an apparatus which can be fitted to the apparatus for carrying out the method according to the invention, for further transportation of building blocks, to the underside of which mortar has been applied.

FIGS. 5 and 6 show a transport apparatus 55 which serves as an elevator and which is also in the form of a frame support structure which is movable on wheels. As can be seen from FIG. 5, the frame support structure of the transport apparatus 55 can be firmly connected releasably by means of a connecting device 57 to the frame support structure 4 of the above-described apparatus for applying mortar to building blocks, in such a way that an elevator frame 59 which is movable up and down in the frame support structure in the direction indicated by the arrow S is aligned in a horizontal direction with the upper longitudinal frame members of the frame support structure 4, when the elevator frame 59 is in its lower operative position shown in solid lines in the Figures. Two rows of support and guide rollers 60 are mounted in that support frame assembly in such a way that in the lower position they prolong the conveyor path for the building blocks 2, which is formed by the support and guide rollers 12 of the frame support structure 4. It will be noted however that not all support and guide rollers 60 of the transport apparatus 55 are mounted to be free-running, but rather at least some thereof are driven by means of an electric motor (not shown) in order to convey a building block 2 which is released from the friction wheel 48 into the transport position shown in FIG. 5, in which it lies entirely on the support and guide rollers 60, with the edge strip portions at its underside which have remained free of mortar in the mortaring operation, without its mortar-coated underside coming into contact with any other parts.

In that position the building block 2 can then be lifted in the direction of the arrow S by means of two electric motors 62, 62 which are mounted in the upper region of the transport apparatus 55 and which respectively drive two cable drums 63, 63, by virtue of the four cables 65 on which the support frame 59 is suspended being wound on to the cable drums 63. In that respect the building block 2 can in principle be lifted to the height shown in broken lines in FIG. 5, but at any event sufficiently far, for example half a meter, above the level of the plane 66 of scaffolding from which the building block is to be used.

At that location the building block 2 which is coated with mortar at its underside can either be removed by hand and laid on the brickwork which has already been erected, or it can be further conveyed in a horizontal direction by means of a transport apparatus of suitable design configuration.

The essential consideration in all these transport procedures is that the mortar-coated underside of the building block 2 always remains facing downwardly so that, even when short-term interruptions in the conveying procedure occur, it is very substantially protected both from incident sunlight and also rain.

In order to accelerate the movement of the elevator frame 59 which is in a downward direction after removal of the building block 2, the assembly may include suitable return springs 67.

It will be appreciated that at least some of the wheels 3 of the frame support structure 4 and also of the wheels 56 of the transport apparatus 55 can be locked in order to prevent the frame support structure 4 or the transport apparatus 55 from unintentionally rolling away while operation is going on. Two of the wheels 56 may also be in the form of castor wheels or steering wheels.

It will be noted that the method according to the invention may alternatively be carried into effect by an apparatus including a pump for conveying mortar from a mortar supply container upwardly into a mortaring region where the apparatus has means for spraying mortar against the underside of the building block to apply mortar thereto. It will accordingly be seen therefrom that the principle of the invention in apparatus terms lies in a mortar supply container for containing a supply of mortar, means for automatically conveying mortar upwardly out of the container to the mortaring region and means for applying mortar to the building block at the underside thereof in the mortaring region.

It will be appreciated that the above-described method and apparatus according to the invention have been set forth solely by way of example and illustration of the invention and that various modifications may be made therein without thereby departing from the spirit and scope of the invention.

I claim:

1. A method for applying mortar to a downwardly facing side of a building block to be laid, comprising the following steps:

keeping ready a supply of mortar in a container, passing said building block by first transport means in a forward feed direction over said supply of mortar thereby supporting said building block only on two narrow edge strip portions of said downwardly facing side, conveying mortar upwardly out of said supply by means of a conveying unit, and applying said upwardly conveyed mortar to said downwardly facing side of said building block by means of an applying unit such that no mortar is applied to said two narrow edge strip portions.

2. A method as set forth in claim 1 wherein the forward feed movement of the building block is at a speed which is in a range of between 15 m/minute and 20 m/minute.

3. A method as set forth in claim 1 further comprising the step of cleaning the building block of loose dust and dirt at least on its underside by moving said building block through a cleaning means before passing it over said supply of mortar.

4. A method as set forth in claim 1 which further comprises the step of passing the building block over a doctor means after having applied said upwardly conveyed mortar to said downwardly facing side of said building block, said doctor means being urged against said downwardly facing side of said building block.

5. A method as set forth in claim 1 further comprising the step of transferring said building block with said mortar on the downwardly facing side thereof to a second transport means which further transports it that it substantially retains its orientation in space such that its mortar-coated side continuously faces downwardly.

6. A method as set forth in claim 1 wherein said conveying unit for conveying mortar upwardly out of said supply comprises a rotary coating roller having a peripheral surface pail of which dips into said supply of mortar, said coating roller rotating about an axis of rotation which extends at least substantially perpendicularly to said forward feed direction, said coating roller thereby conveying mortar out of said supply upwardly and pressing it against the underside of said building block by part of its peripheral surface.

7. A method as set forth in claim 6 wherein the part of the peripheral surface of said coating roller which presses mortar against the downwardly facing side of said building block moves In the same direction as said building block.

8. A method as set forth in claim 1 further comprising the step of stirring said supply of mortar by a stirring means.

9. A method as set forth in claim 8 wherein said stirring means comprises a stirring roller disposed in said supply of mortar and rotating about an axis of rotation which is in parallel relationship with said axis of rotation of said coating roller.

10. A method as set forth in claim 1 wherein the step of passing said building block in a forward feed direction by a first transport means comprises the use of at least one friction wheel which is pressed against one side of said building block being different from said downwardly facing side thereof, said friction wheel being rotatingly driven by a motor.

* * * * *